US008638271B2

(12) United States Patent
Wang et al.

(10) Patent No.: US 8,638,271 B2
(45) Date of Patent: Jan. 28, 2014

(54) MULTI-BAND ANTENNA

(75) Inventors: Chun-Yuan Wang, Tainan (TW); Chi-Yin Fang, Tao Yuan Shien (TW)

(73) Assignee: Quanta Computer Inc., Tao Yuan Hsien (TW)

( * ) Notice: Subject to any disclaimer, the term of this patent is extended or adjusted under 35 U.S.C. 154(b) by 461 days.

(21) Appl. No.: 13/066,505

(22) Filed: Apr. 14, 2011

(65) Prior Publication Data

US 2012/0081264 A1 Apr. 5, 2012

(30) Foreign Application Priority Data

Oct. 4, 2010 (TW) ..... 99133683 A

(51) Int. Cl.
*H01Q 1/48* (2006.01)

(52) U.S. Cl.
USPC ..... 343/846; 343/905; 343/700 MS

(58) Field of Classification Search
USPC ..... 343/905, 846, 700 MS
See application file for complete search history.

(56) References Cited

U.S. PATENT DOCUMENTS

2007/0030200 A1* 2/2007 Heng et al. ..... 343/700 MS
2009/0115665 A1* 5/2009 Hung et al. ..... 343/700 MS

* cited by examiner

*Primary Examiner* — Kristy A Haupt
(74) *Attorney, Agent, or Firm* — Kramer Levin Naftalis & Frankel LLP

(57) ABSTRACT

A multi-band antenna includes a dielectric substrate, and a main antenna member and a metal piece disposed on the dielectric substrate. The main antenna member includes a feed-in portion for feeding with a radio frequency signal, a first conductor arm connected to the feed-in portion and adjacent to a first side edge of the dielectric substrate, a second conductor arm connected to the feed-in portion and having a length shorter than that of the first conductor arm, a third conductor arm connected to the feed-in portion, a fourth conductor arm extending along the third conductor arm, and a grounding portion adjacent to the feed-in portion. The metal piece is disposed at the first side edge and connected to the fourth conductor arm, resonates and couples with the first conductor arm to form a first radiator section, and cooperates with the fourth conductor arm to form a second radiator section.

10 Claims, 12 Drawing Sheets

MULTI-BAND ANTENNA

CROSS-REFERENCE TO RELATED APPLICATION

This application claims priority of Taiwanese Application No. 099133683, filed on Oct. 4, 2010.

BACKGROUND OF THE INVENTION

1. Field of the Invention

The present invention relates to an antenna, more particularly to a long term evolution multi-band antenna.

2. Description of the Related Art

Long Term Evolution (LTE) technology is attracting the interest of many in the field of mobile networks. The LTE specification provides a downlink peak rate of at least 100 Mbit/s and an uplink peak rate of at least 50 Mbit/s in a bandwidth of 20 MHz, and supports older mobile network technologies such as the present 3G system. The LTE technology enables service providers to provide wireless broadband services in a more economical way, and outperforms the present 3G system. LTE standard covers different frequency bands defined by different countries as shown in Table 1 with ranges from 698 to 960 MHz, 1710 to 2170 MHz, and 2500 to 2700 MHz. However, low frequency bandwidths in which conventional PIFA antennas commonly applied in current notebook computers are operable may not satisfy the LTE requirements.

Thus, an antenna capable of operating in the aforementioned LTE frequency bands and other frequency bands, such as GSM850, EGSM900, PCS1800, DCS1900, and WCDMA2100, with adequate operation bandwidth is the subject of this invention.

TABLE 1

| Operating Band | UL Frequencies (MHz) | DL Frequencies (MHz) | Region |
|---|---|---|---|
| Band I | 1920-1980 | 2110-2170 | Europe, Asia, Oceania |
| Band II | 1850-1910 | 1930-1990 | Americas |
| Band III | 1710-1785 | 1805-1880 | Europe |
| Band IV | 1710-1755 | 2110-2155 | Americas |
| Band V | 824-849 | 869-894 | USA, Australia |
| Band VI | 830-840 | 875-885 | Japan |
| Band VII | 2500-2570 | 2620-2690 | Europe |
| Band VIII | 880-915 | 925-960 | Europe |
| Band IX | 1749.9-1784.9 | 1844.9-1879.9 | Japan |
| Band X | 1710-1770 | 2110-2170 | Europe |
| Band XI | 1427.9-1425.9 | 1475.9-1500.9 | Japan |
| Band XII | 698-716 | 728-746 | USA, Canada |
| Band XIII | 777-787 | 746-756 | USA, Canada |
| Band XIV | 788-798 | 758-768 | USA, Canada |
| Band XVII | 704-716 | 734-746 | USA, Canada |

SUMMARY OF THE INVENTION

Therefore, an object of the present invention is to provide a multi-band antenna capable of covering multiple operation bandwidths.

Accordingly, a multi-band antenna of the present invention includes a dielectric substrate, a main antenna member, and a metal piece. The main antenna member is disposed on a surface of the dielectric substrate, and includes a feed-in portion, a first conductor arm, a second conductor arm, a third conductor arm, a fourth conductor arm, and a grounding portion.

The dielectric substrate has a first side edge, a second side edge adjacent to the first side edge, a third side edge opposite to the second side edge, and a fourth side edge opposite to the first side edge.

The feed-in portion is for feeding with a radio frequency signal. The first conductor arm is connected to the feed-in portion, and extends adjacent to and along the first side edge toward the second side edge of the dielectric substrate. The second conductor arm is connected to the feed-in portion, is disposed adjacent to the first conductor arm, and has a length shorter than that of the first conductor arm. The third conductor arm is connected to the feed-in portion, and extends toward the third side edge of the dielectric substrate for transmitting the radio frequency signal. The fourth conductor arm extends from the first side edge toward the fourth side edge of the dielectric substrate, and has a part extending along and spaced apart from the third conductor arm for coupling of the radio frequency signal. The grounding portion is disposed at the fourth side edge and adjacent to the feed-in portion.

The metal piece is disposed at the first side edge of the dielectric substrate and is connected to the fourth conductor arm. The metal piece resonates and couples with the first conductor arm to form a first radiator section, and cooperates with the fourth conductor arm to form a second radiator section.

Preferably, for suitably adjusting operation bandwidth of the second radiator section, the main antenna member further includes a fifth conductor arm. The fifth conductor arm is disposed adjacent to one side of the fourth conductor arm that is opposite to the third conductor arm. The fifth conductor arm extends to the first side edge of the dielectric substrate to connect with the metal piece, and cooperates with the fourth conductor arm and the metal piece to form the second radiator section.

Preferably, for suitably adjusting operation bandwidth of the first radiator section, the main antenna member further includes an extension section disposed at the first side edge of the dielectric substrate and connected to the metal piece. The extension section extends toward the first conductor arm for coupling therewith.

Preferably, the main antenna member further includes a common section, a conducting line, and a conductor foil. The common section is connected to one end of the first conductor arm and one end of the second conductor arm. The conducting line interconnects the common section and the feed-in portion. The conductor foil is connected to the grounding portion and the fourth conductor arm.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
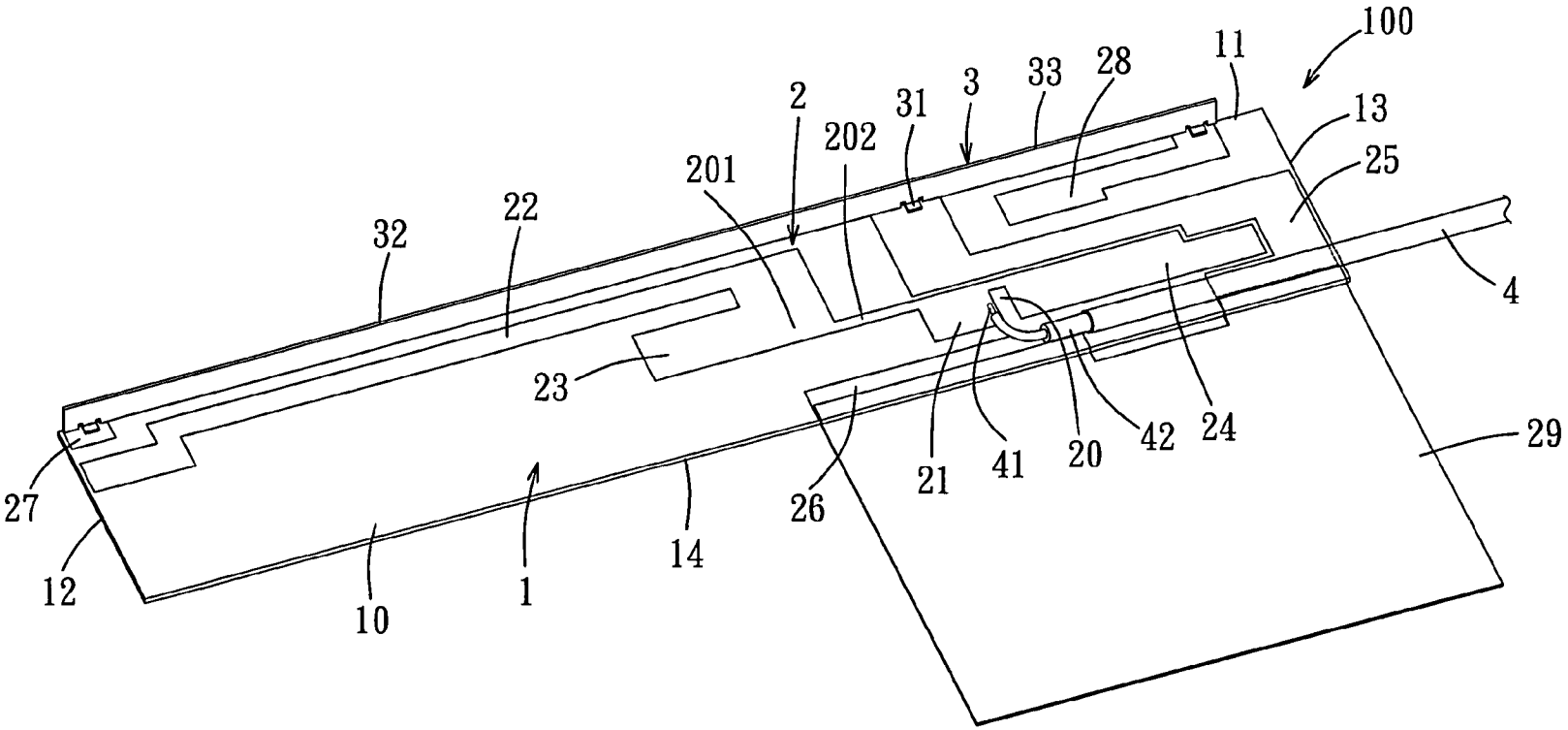
FIG. 1 is a perspective view of a preferred embodiment of the multi-band antenna of the present invention.

Referring to FIG. 1, a preferred embodiment of a multi-band antenna of the present invention is illustrated. The multi-band antenna 100 of this embodiment includes a dielectric substrate 1, a main antenna member 2, and a metal piece (e.g., an iron piece) 3.

In this embodiment, the dielectric substrate 1 is a rectangular plate body with dimensions of 73.7×14×3 $mm^3$, and has a first side edge 11, a second side edge 12 adjacent to the first side edge 11, a third side edge 13 opposite to the second side edge 12, and a fourth side edge 14 opposite to the first side edge 11.

The main antenna member 2 is disposed on a surface 10 of the dielectric substrate 1, and includes a feed-in portion 21, a first conductor arm 22, a second conductor arm 23, a third conductor arm 24, a fourth conductor arm 25, and a grounding portion 26.

The feed-in portion 21 is generally rectangular and is disposed adjacent to a center of the surface 10 of the dielectric substrate 1 to connect with a signal line 41 of a coaxial cable 4 for feeding with a radio frequency signal.

Figure 2:
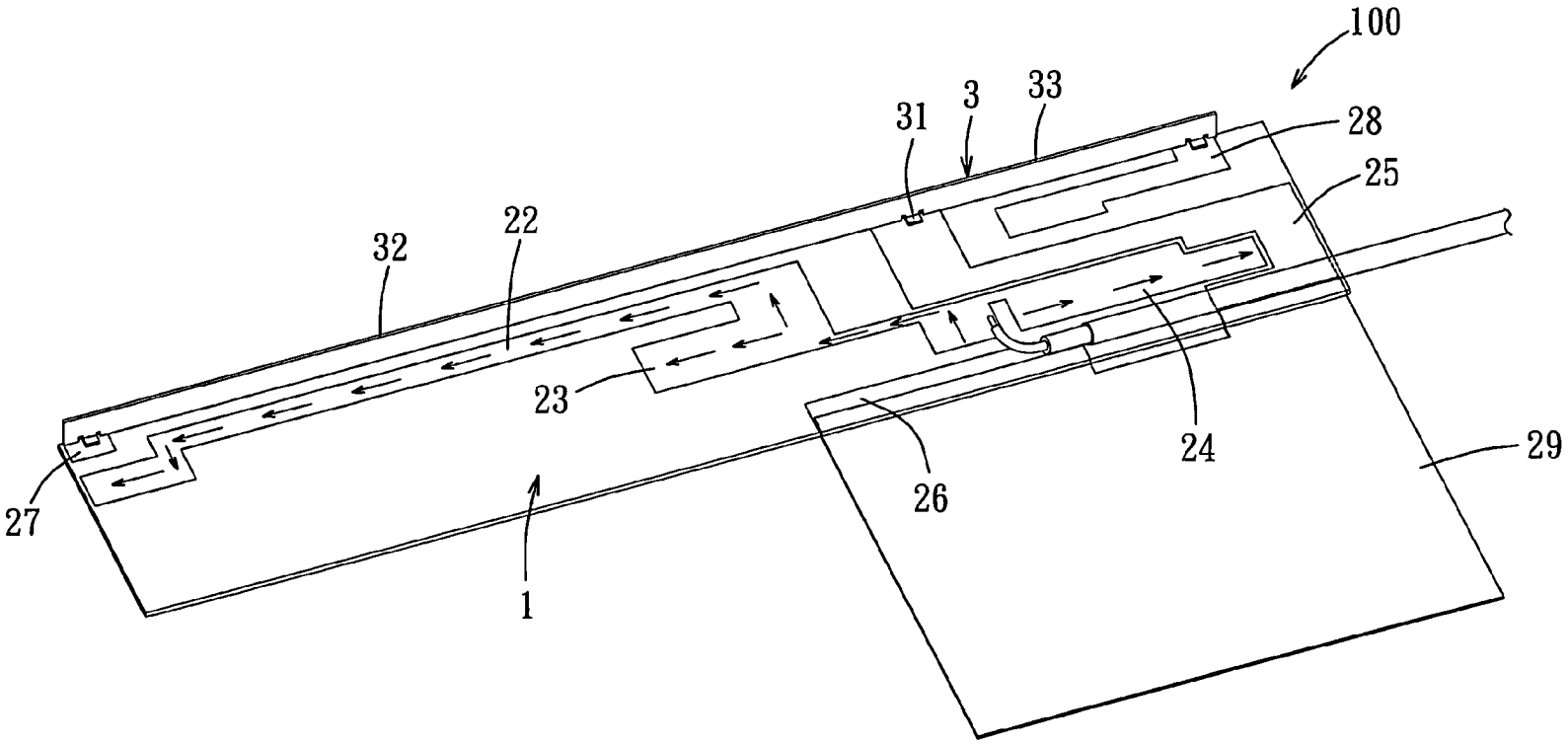
FIG. 2 is a perspective view illustrating transmission direction of a radio frequency signal in a first conductor arm, a second conductor arm, and a third conductor arm of the preferred embodiment of the multi-band antenna.

Each of the first conductor arm 22 and the second conductor arm 23 has one end connected to a common section 201. The common section 201 is connected to the feed-in portion 21 through a conducting line 202 for feeding the first conductor arm 22 and the second conductor arm 23 with the radio frequency signal, wherein arrows in FIG. 2 indicate transmission directions of the radio frequency signal. The first conductor arm 22 extends adjacent to and substantially parallel with the first side edge 11 toward the second side edge 12 of the dielectric substrate 1. Moreover, another end of the first conductor arm 22 adjacent to the second side edge 12 is formed into a generally L-shaped bend.

The second conductor arm 23 is disposed adjacent to and apart from the first conductor arm 22, and extends substantially parallel with the first conductor arm 22. Furthermore, the second conductor arm 23 has a length shorter than that of the first conductor arm 22.

The third conductor arm 24 is connected to the feed-in portion 21, and a notch 20 is formed therebetween. The third conductor arm 24 extends from the feed-in portion 21 toward the third side edge 13 of the dielectric substrate 1 for transmitting the radio frequency signal, wherein the arrows in FIG. 2 indicate transmission directions of the radio frequency signal.

Figure 3:
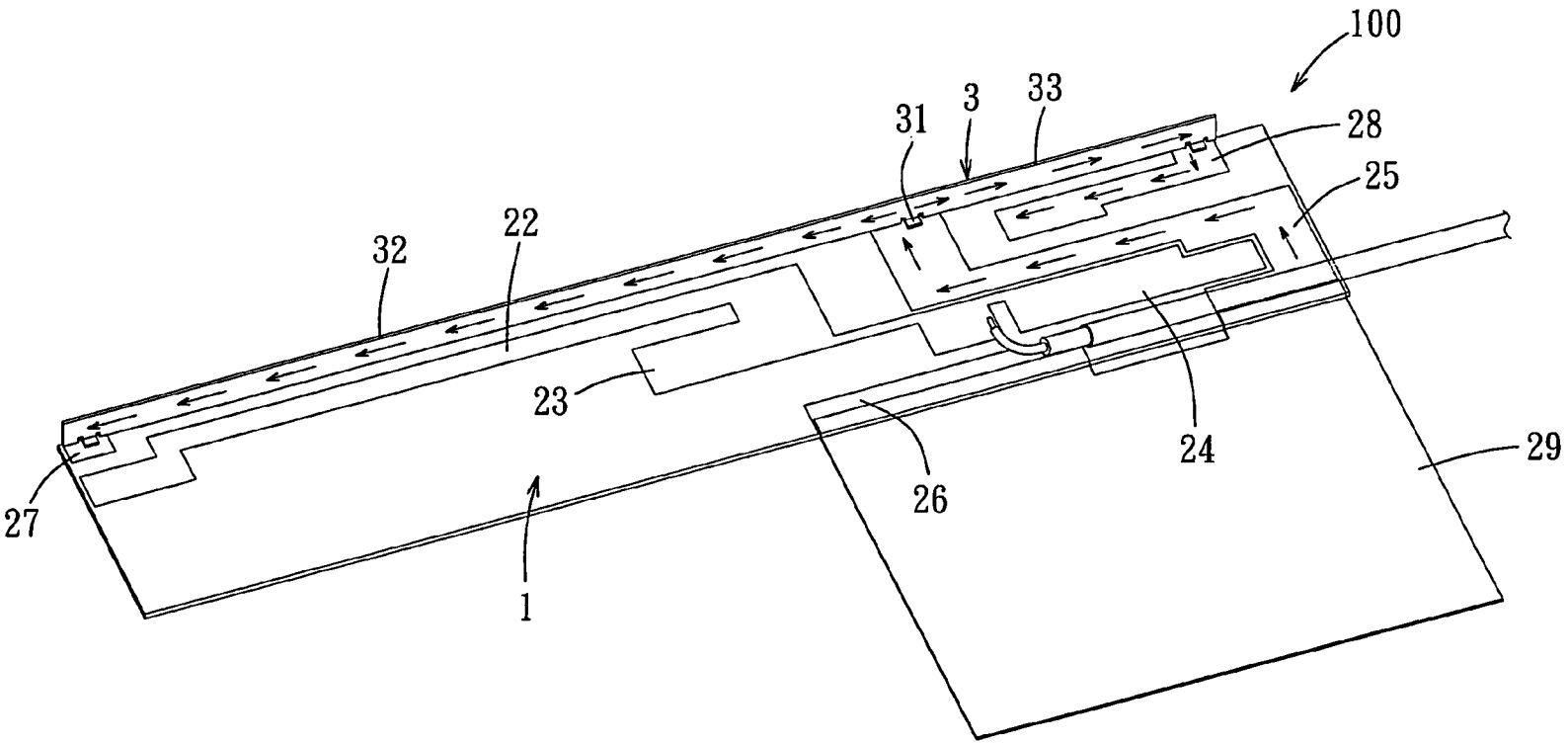
FIG. 3 is a perspective view illustrating transmission direction of a radio frequency signal in a fourth conductor arm, a metal piece, and a fifth conductor arm of the preferred embodiment of the multi-band antenna.

The fourth conductor arm 25 extends from the first side edge 11 toward the fourth side edge 14 of the dielectric substrate 1, and has a part extending along and adjacent to the third conductor arm 24 for coupling of the radio frequency signal, wherein arrows in FIG. 3 indicate transmission directions of the radio frequency signal.

The grounding portion 26 is disposed at the fourth side edge 14 and adjacent to the feed-in portion 21 for connection with a grounding line 42 of the coaxial cable 4.

The metal piece 3, substantially in a shape of a long strip in this embodiment, is disposed at the first side edge 11 of the dielectric substrate 1, is substantially perpendicular to the dielectric substrate 1, and is connected to one end of the fourth conductor arm 25 at a junction 31. In this way, as shown by the arrows in FIG. 3, the radio frequency signal is transmitted from the junction 31 toward a first piece end and a second piece end of the metal piece 3, such that a first metal section 32 of the metal piece 3 extending from the junction 31 toward the first piece end resonates and couples with the adjacent first conductor arm 22 to form a first radiator section, and such that a second metal section 33 of the metal piece 3 extending from the junction 31 toward the second piece end resonates and couples with the fourth conductor arm 25 to form a second radiator section.

In order to adjust a total length of the first radiator section for operation in a specific frequency band, the first radiator section of the preferred embodiment further includes an extension section 27 disposed at the first side edge 11 of the dielectric substrate 1 and connected to the first piece end of the first metal section 32 of the metal piece 3. The extension section 27 extends toward the another end of the first conductor arm 21 for coupling therewith. Moreover, in order to adjust a total length of the second radiator section for operation in a specific frequency band, the second radiator section of the preferred embodiment further includes a fifth conductor arm 28. The fifth conductor arm 28 is disposed adjacent to one side of the fourth conductor arm 25 that is opposite to the third conductor arm 24. The fifth conductor arm 28 extends substantially parallel with the fourth conductor arm 25, and has an end connected to the second piece end of the second metal section 33 of the metal piece 3.

In this embodiment, the total length of the first radiator section is greater than that of the second radiator section, and the second conductor arm 23 has a length shorter than the total length of the second radiator section. The total length of the first radiator section is designed such that the first radiator section may resonate in a first frequency band ranging from 698 MHz to 960 MHz. The total length of the second radiator section is designed such that the second radiator section may resonate in a second frequency band higher than the first frequency band and ranging from 1710 MHz to 2170 MHz. The length of the second conductor arm 23 is designed such that the second conductor arm 23 may resonate in a third frequency band higher that the second frequency band and ranging from 2500 MHz to 2700 MHz.

Figure 4:
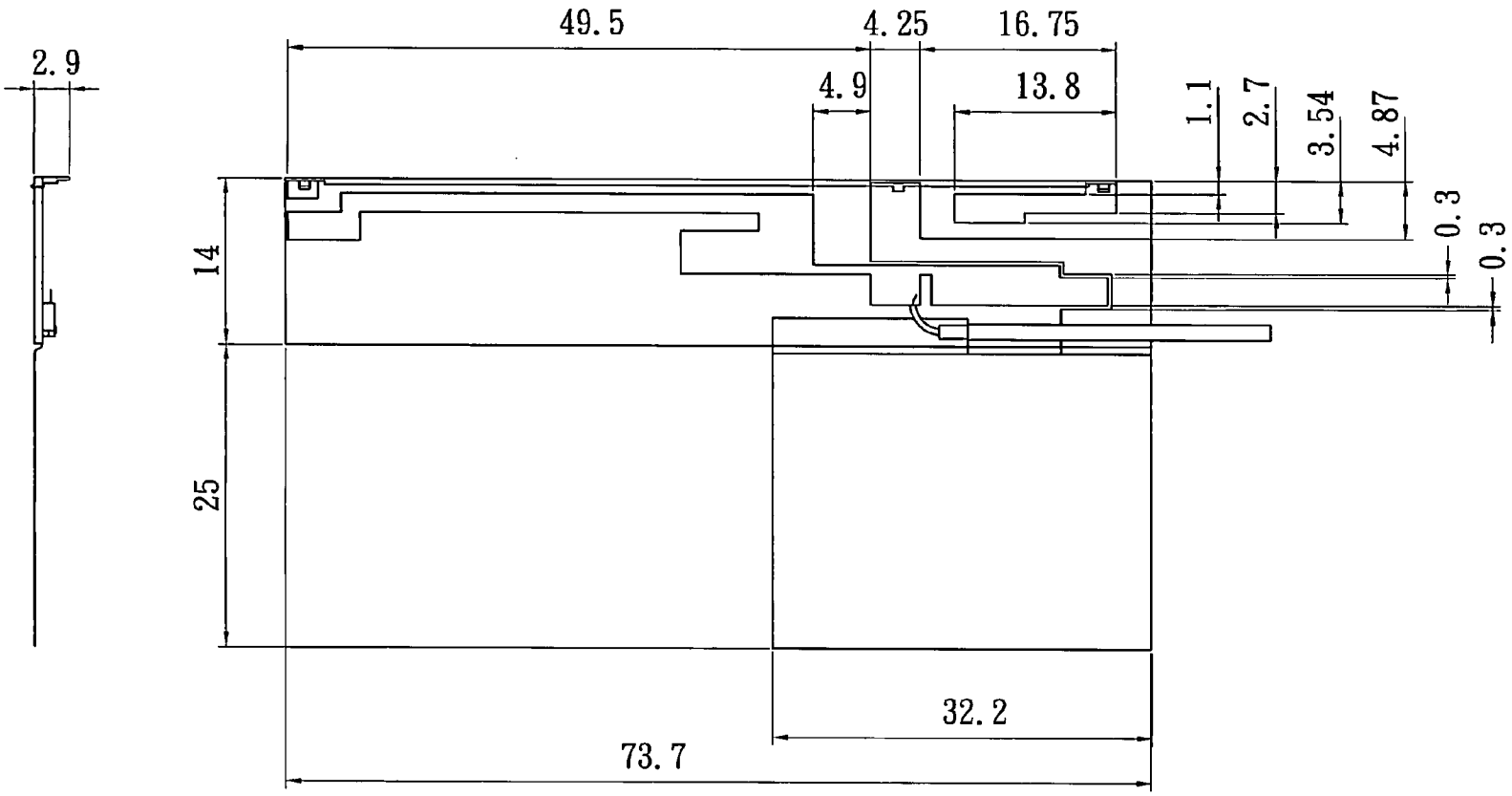
FIG. 4 is a schematic view illustrating dimensions of the preferred embodiment.

In this embodiment, the multi-band antenna 100 has total dimensions of 73.7×14×3 $mm^3$, and specific dimensions of the main antenna member 2 and the metal piece 3 are shown in FIG. 4 (unit: mm).

Furthermore, for increasing grounding area of the multi-band antenna 100, the preferred embodiment further includes a conductor foil 29 connected to the grounding portion 26 and the fourth conductor arm 25, respectively.

Figure 5:
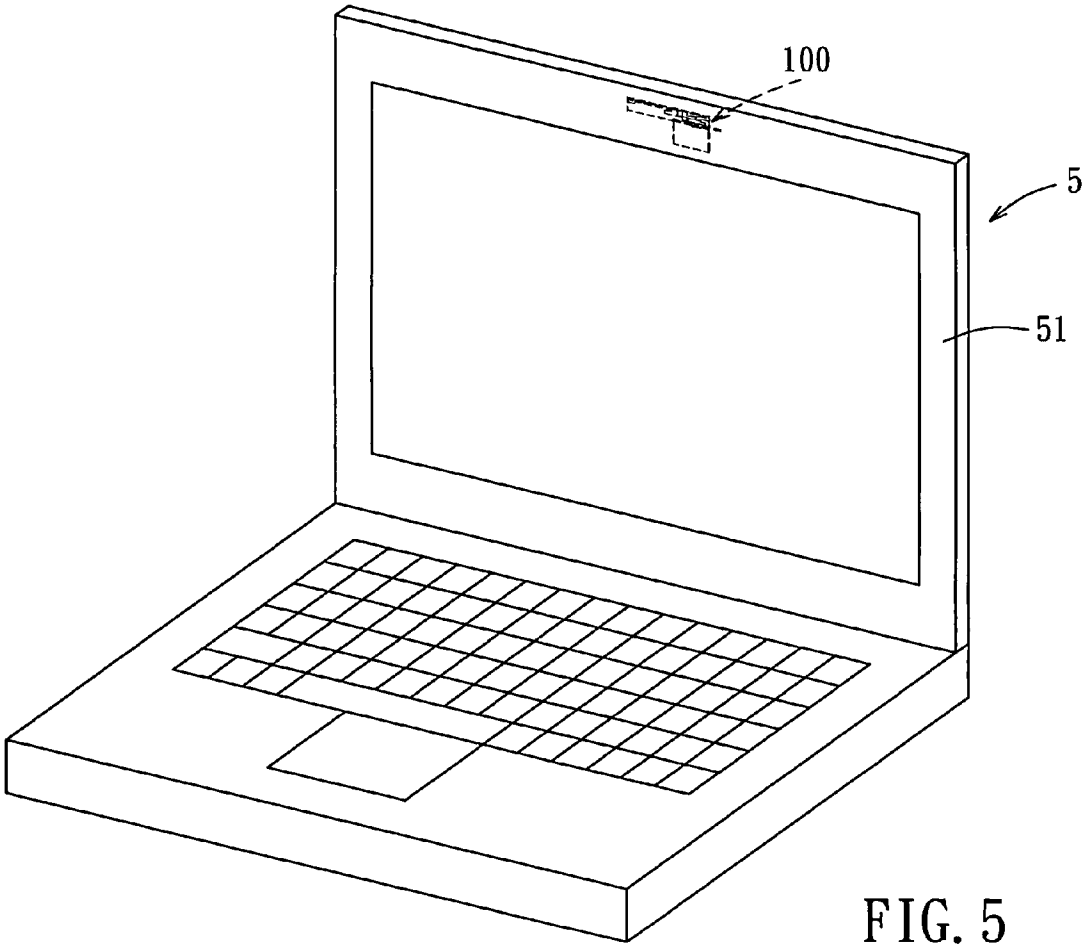
FIG. 5 illustrates a placement position of the multi-band antenna of the preferred embodiment on a notebook computer.

Referring to FIG. 5, the multi-band antenna 100 of the preferred embodiment is usually disposed at an edge above a display, in a cover body 51 of a notebook computer 5.

Figure 6:
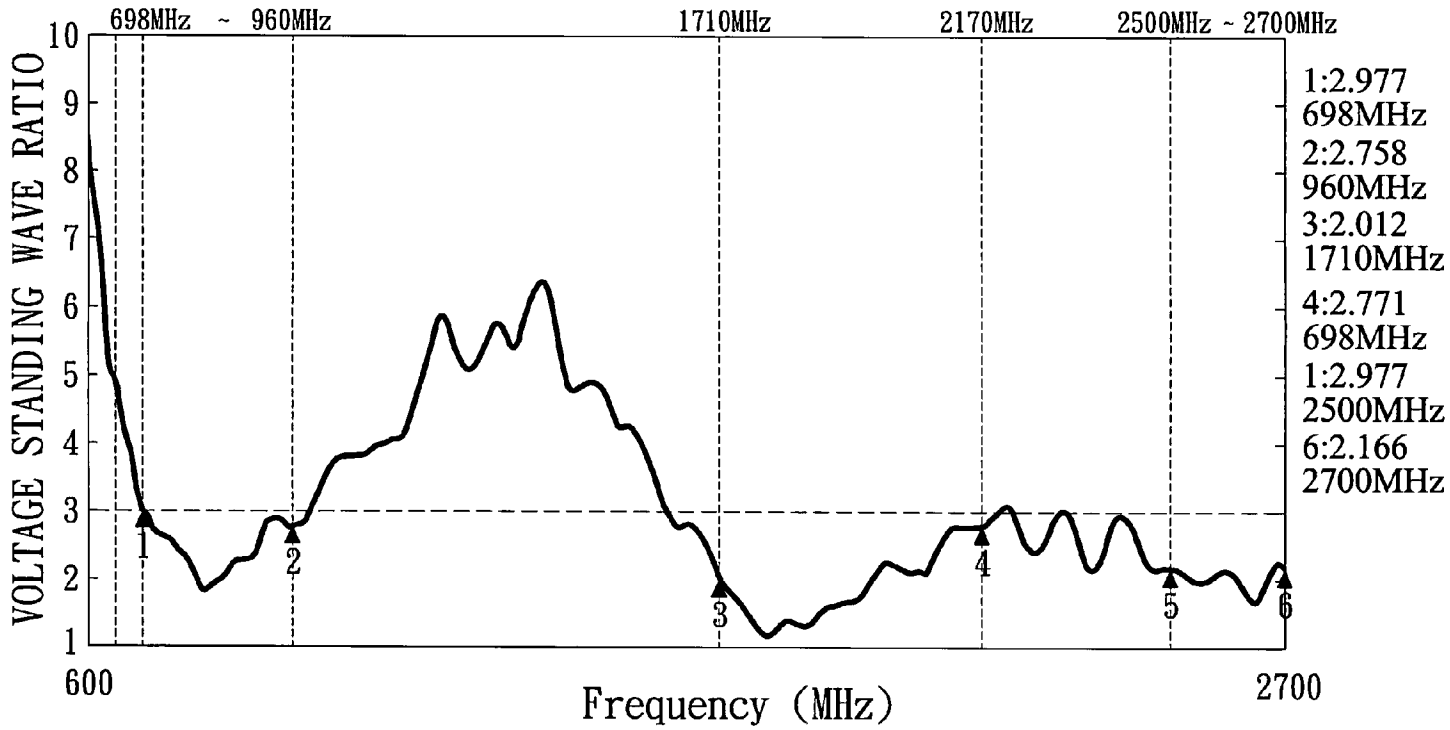
FIG. 6 is a Voltage Standing Wave Ratio (VSWR) plot of the multi-band antenna of the preferred embodiment.
Figure 7:
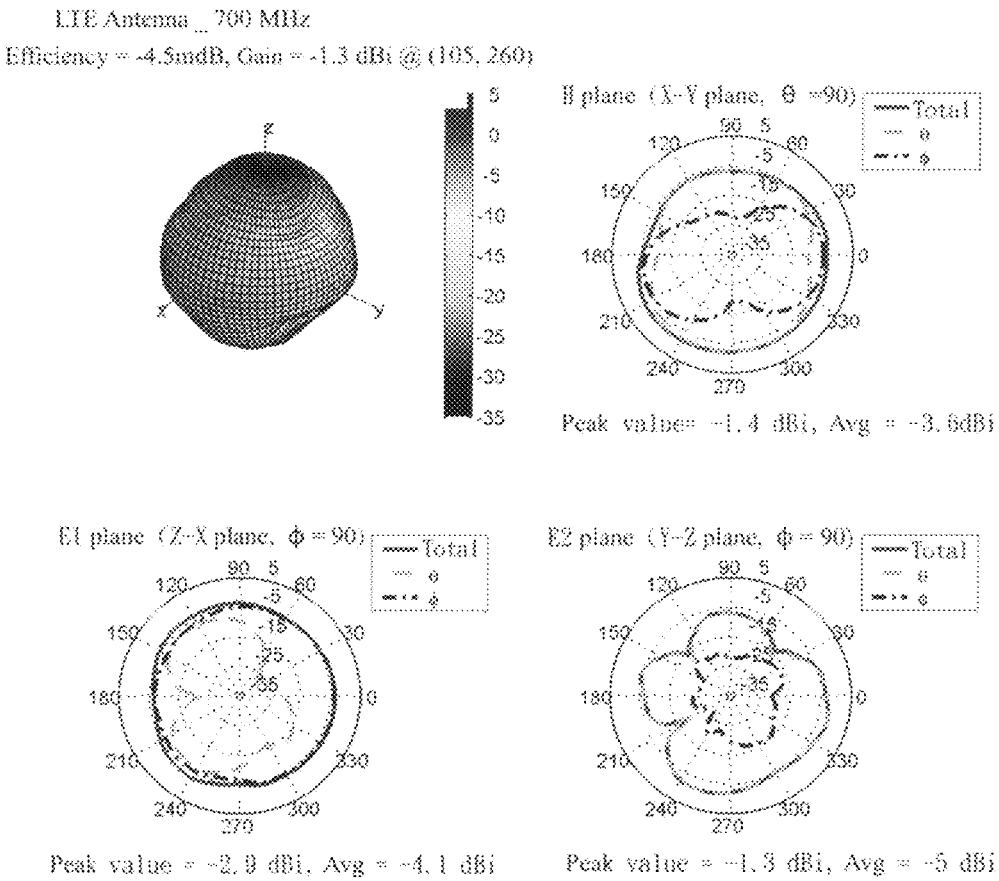
FIG. 7 illustrates radiation patterns of the multi-band antenna of the preferred embodiment operating at 700 MHz.
Figure 8:
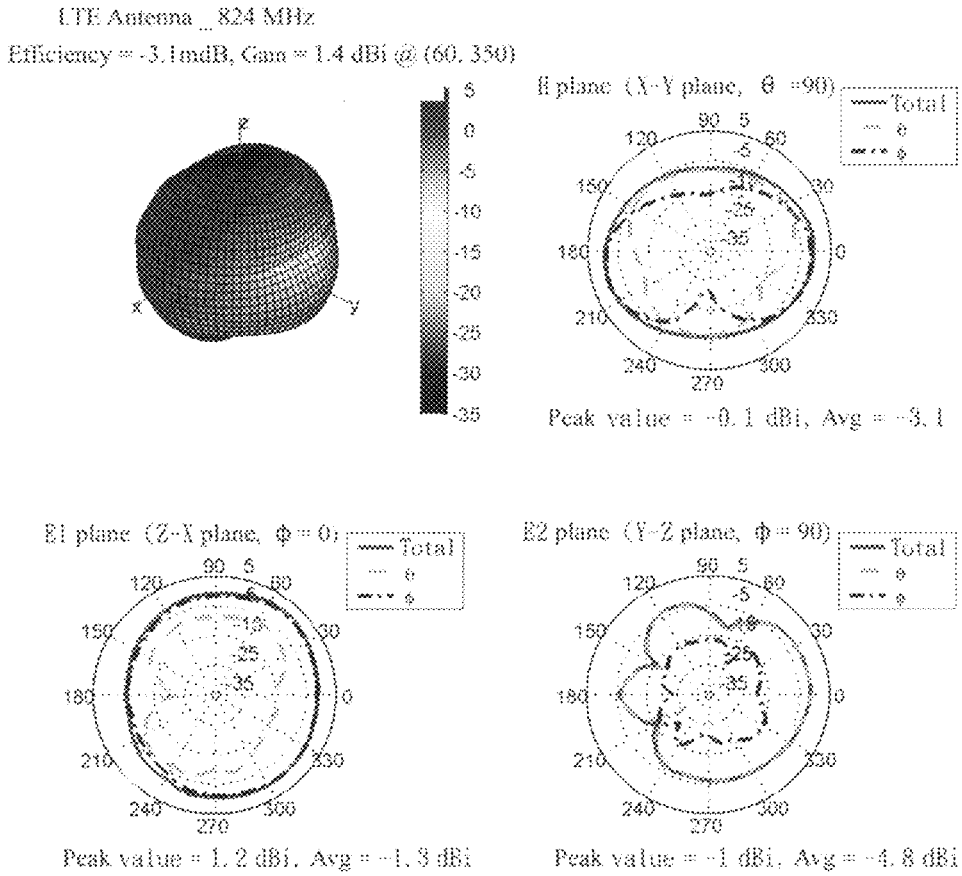
FIG. 8 illustrates radiation patterns of the multi-band antenna of the preferred embodiment operating at 824 MHz.
Figure 9:
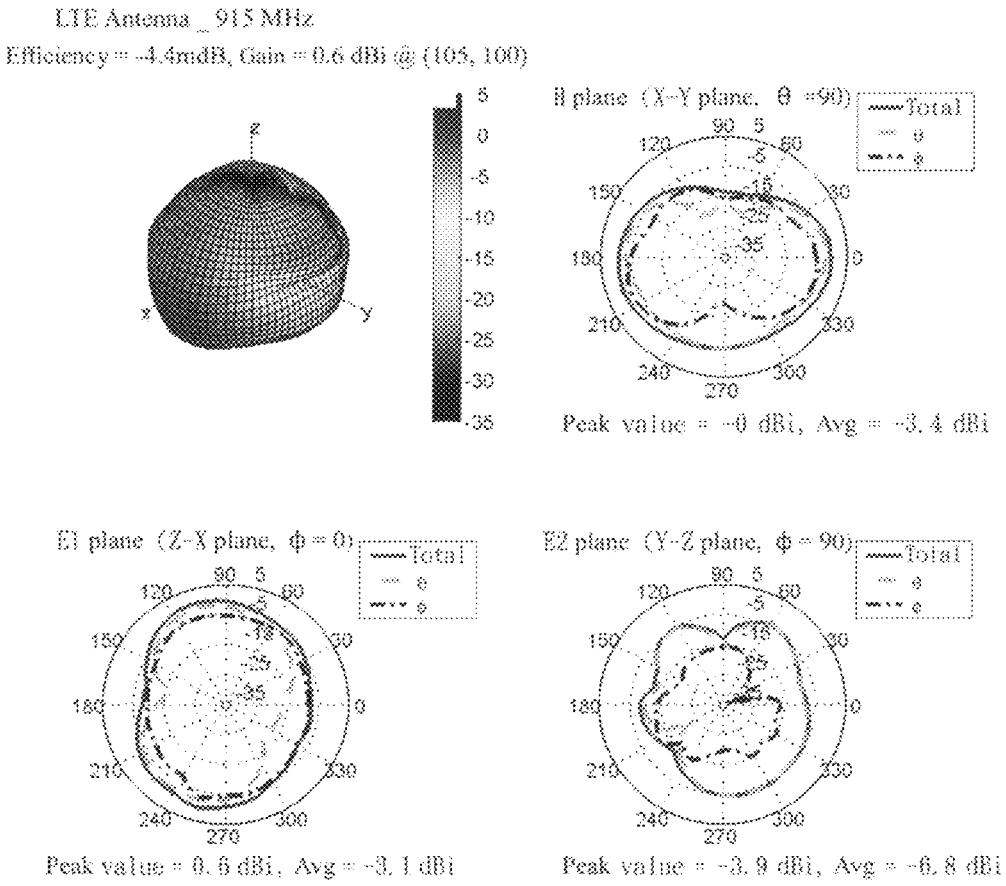
FIG. 9 illustrates radiation patterns of the multi-band antenna of the preferred embodiment operating at 915 MHz.
Figure 10:
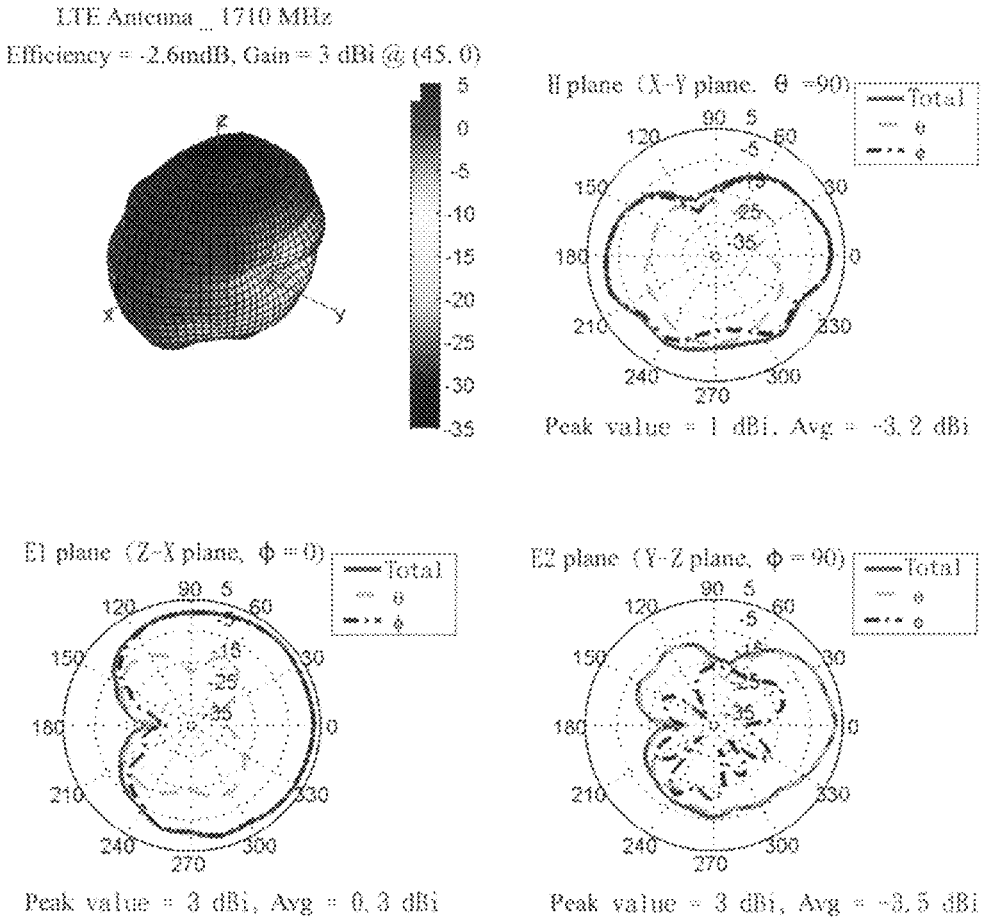
FIG. 10 illustrates radiation patterns of the multi-band antenna of the preferred embodiment operating at 1710 MHz.
Figure 11:
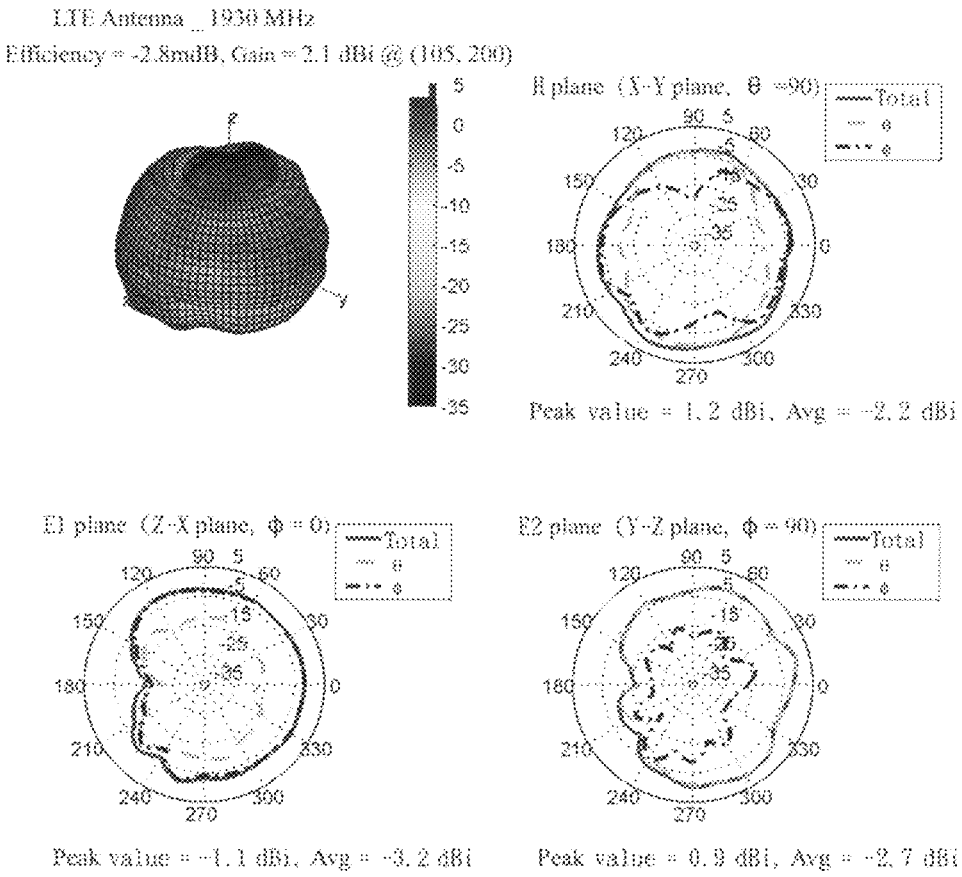
FIG. 11 illustrates radiation patterns of the multi-band antenna of the preferred embodiment operating at 1930 MHz.
Figure 12:
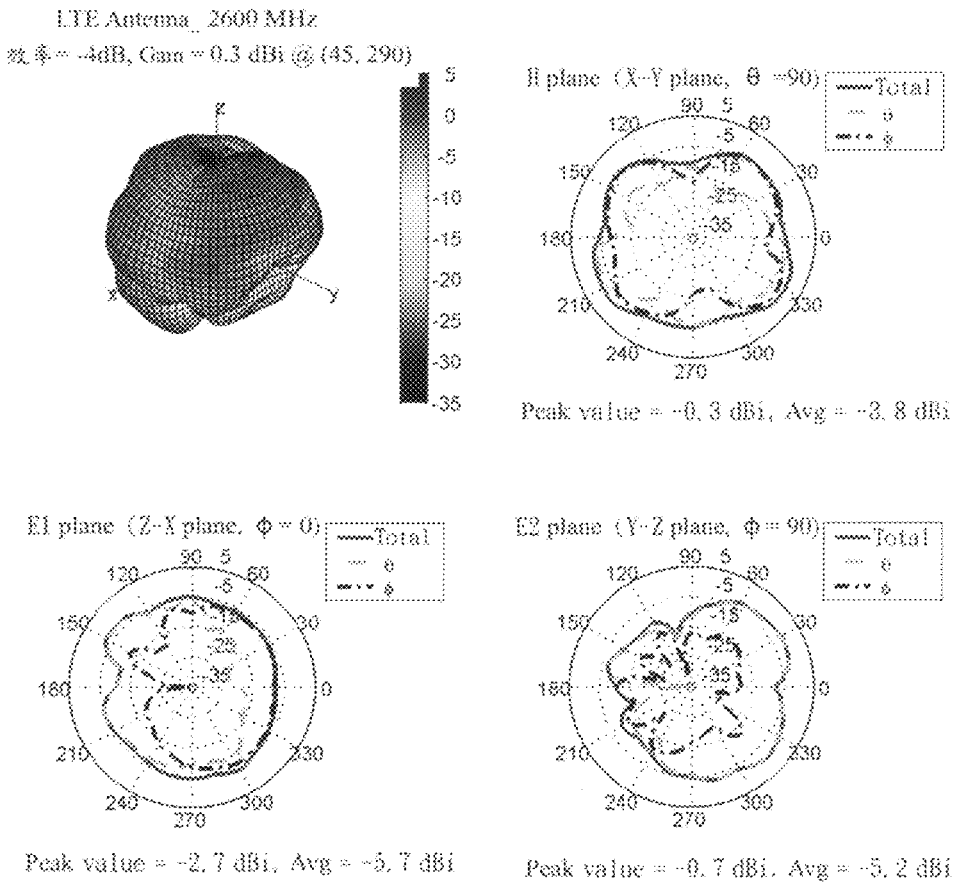
FIG. 12 illustrates radiation patterns of the multi-band antenna of the preferred embodiment operating at 2600 MHz.

Referring to FIG. 6, a Voltage Standing Wave Ratio (VSWR) plot of the multi-band antenna 100 of the preferred embodiment is illustrated. It is shown in FIG. 6 that, when the multi-band antenna 100 operates in operation frequency bands ranging from 698~960 MHz, 2170~2700 MHz, and 2500~2700 MHz, the resulting VSWR values are all not greater than 3 so as to satisfy requirements for antenna radiation efficiency in the industry.

Referring to the following Table 2, total radiated power (Tot. Rad. Pwr.) and radiation efficiency (Efficiency) of the multi-band antenna 100 of the preferred embodiment are illustrated.

TABLE 2

| Frequency (MHz) | Tot. Rad. Pwr. (dBm) | Efficiency (%) |
|---|---|---|
| 700 | −4.5 | 35.1 |
| 715 | −4.0 | 40.2 |
| 730 | −3.1 | 48.6 |
| 745 | −2.3 | 59.4 |
| 760 | −2.4 | 57.2 |
| 775 | −3.0 | 50.0 |
| 790 | −3.1 | 49.1 |
| 805 | −2.4 | 57.8 |
| 820 | −2.7 | 53.8 |
| 824 | −3.1 | 49.5 |
| 836.6 | −3.9 | 40.8 |
| 849 | −3.7 | 42.2 |
| 869 | −3.1 | 49.0 |
| 881.6 | −3.1 | 49.4 |
| 880 | −3.0 | 49.8 |
| 894 | −3.2 | 48.1 |
| 897.4 | −3.3 | 46.4 |
| 915 | −4.4 | 36.3 |
| 925 | −3.9 | 41.1 |
| 942.4 | −3.6 | 43.9 |
| 960 | −3.7 | 43.1 |
| 1710 | −2.6 | 55.5 |
| 1747.8 | −1.5 | 70.1 |
| 1785 | −1.9 | 64.9 |
| 1805 | −2.2 | 60.4 |
| 1842.8 | −2.9 | 51.5 |
| 1850 | −2.8 | 52.2 |
| 1880 | −2.8 | 52.1 |
| 1910 | −2.8 | 52.5 |
| 1920 | −2.8 | 52.6 |
| 1930 | −2.8 | 52.7 |
| 1950 | −3.0 | 50.2 |
| 1960 | −3.1 | 49.0 |
| 1980 | −3.4 | 45.6 |
| 1990 | −3.4 | 45.4 |
| 2110 | −4.1 | 38.7 |
| 2140 | −4.6 | 35.0 |
| 2170 | −5.0 | 31.9 |
| 2500 | −4.0 | 40.0 |
| 2520 | −3.8 | 41.5 |
| 2540 | −4.0 | 40.1 |
| 2560 | −4.4 | 36.4 |
| 2580 | −4.7 | 34.0 |
| 2600 | −4.0 | 40.1 |
| 2620 | −3.9 | 40.7 |
| 2640 | −3.8 | 42.1 |
| 2660 | −4.2 | 38.4 |
| 2680 | −4.3 | 37.5 |
| 2700 | −4.6 | 34.6 |

Referring to FIG. 7 to FIG. 12, radiation patterns of the multi-band antenna 100 of the preferred embodiment in different operation frequencies are illustrated. It is evident from these figures that the radiation patterns of the multi-band antenna 100 have relatively good omni-directionality.

In summary, the multi-band antenna 100 of the preferred embodiment uses two low frequency paths, i.e., the first conductor arm 22 resonating and coupling with the first metal section 32 of the metal piece 3 to generate a plurality of modes for achieving a demand of operating in low frequency and broad band (698 MHz to 960 MHz). The multi-band antenna 100 of the preferred embodiment further uses the second metal section 33 of the metal piece 3 to generate a high frequency (1710 MHz to 2170 MHz) mode, and uses the third conductor arm 24 to couple with the fourth conductor arm 25 for adjusting high frequency matching thereof. Furthermore, the second conductor arm 23 may resonate to generate a higher frequency (2500 MHz to 2700 MHz) mode, such that operation frequency bands of the multi-band antenna 100 not only include GSM850, EGSM900, PCS1800, DCS1900, and WCDMA 2100 but also include long term evolution (LTE) operation frequency bands of 698 MHz to 798 MHz and 2500 MHz to 2700 MHz.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A multi-band antenna comprising:

a dielectric substrate having a first side edge, a second side edge adjacent to said first side edge, a third side edge opposite to said second side edge, and a fourth side edge opposite to said first side edge;

a main antenna member disposed on a surface of said dielectric substrate and including:

a feed-in portion for feeding with a radio frequency signal;

a first conductor arm connected to said feed-in portion, and extending adjacent to and along said first side edge toward said second side edge of said dielectric substrate;

a second conductor arm connected to said feed-in portion, disposed adjacent to said first conductor arm, and having a length shorter than that of said first conductor arm;

a third conductor arm connected to said feed-in portion, and extending toward said third side edge of said dielectric substrate for transmitting the radio frequency signal;

a fourth conductor arm extending from said first side edge toward said fourth side edge of said dielectric substrate, and having a part extending along and spaced apart from said third conductor arm for coupling of the radio frequency signal; and a grounding portion disposed at said fourth side edge and adjacent to said feed-in portion; and a metal piece disposed at said first side edge of said dielectric substrate and connected to said fourth conductor arm, said metal piece resonating and coupling with said first conductor arm to form a first radiator section, and cooperating with said fourth conductor arm to form a second radiator section.

2. The multi-band antenna as claimed in claim 1, wherein said main antenna member further includes a fifth conductor arm, said fifth conductor arm being disposed adjacent to one side of said fourth conductor arm that is opposite to said third conductor arm, said fifth conductor arm extending to said first side edge to connect with said metal piece, and cooperating with said fourth conductor arm and said metal piece to form said second radiator section.

3. The multi-band antenna as claimed in claim 2, wherein said main antenna member further includes a common section connected to one end of said first conductor arm and one end of said second conductor arm, and a conducting line interconnecting said common section and said feed-in portion.

4. The multi-band antenna as claimed in claim 1, wherein said main antenna member further includes an extension section disposed at said first side edge of said dielectric substrate, and connected to said metal piece, said extension section extending toward said first conductor arm for coupling therewith.

5. The multi-band antenna as claimed in claim 4, wherein said main antenna member further includes a common section connected to one end of said first conductor arm and one end of said second conductor arm, and a conducting line interconnecting said common section and said feed-in portion.

6. The multi-band antenna as claimed in claim 1, wherein said main antenna member further includes a common section connected to one end of said first conductor arm and one end of said second conductor arm, and a conducting line interconnecting said common section and said feed-in portion.

7. The multi-band antenna as claimed in claim 1, wherein said main antenna member further includes a conductor foil connected to said grounding portion and said fourth conductor arm.

8. The multi-band antenna as claimed in claim 1, further comprising a coaxial cable having a signal line connected to said feed-in portion, and a grounding line connected to said grounding portion.

9. The multi-band antenna as claimed in claim 1, wherein said first radiator section is capable of resonating in a first frequency band, said second radiator section being capable of resonating in a second frequency band higher than the first frequency band, said second conductor arm being capable of resonating in a third frequency band higher than the second frequency band.

10. The multi-band antenna as claimed in claim 9, wherein the first frequency band ranges from 698 MHz to 960 MHz, the second frequency band ranging from 1710 MHz to 2170 MHz, the third frequency band ranging from 2500 MHz to 2700 MHz.

* * * * *